United States Patent [19]

Stanford

[11] 4,220,065

[45] Sep. 2, 1980

[54] HAMBURGER BUNS AND METHOD OF PREPARING SAME

[75] Inventor: Arthur Stanford, Richmond, Va.

[73] Assignee: AMF Incorporated, White Plains, N.Y.

[21] Appl. No.: 911,855

[22] Filed: Jun. 2, 1978

[51] Int. Cl.[2] ..... B26D 3/08

[52] U.S. Cl. ..... 83/873; 426/549; 426/518

[58] Field of Search ..... 426/549, 138, 518; 83/4, 864, 873

[56] References Cited

U.S. PATENT DOCUMENTS

| | | | |
|---|---|---|---|
| 2,738,817 | 5/1951 | Wadoz | 83/4 |
| 3,112,780 | 1/1961 | Lecrone | 83/4 |
| 3,192,976 | 7/1965 | Clock | 83/4 |
| 3,669,165 | 6/1972 | Tobey et al. | 83/102.1 |
| 3,911,769 | 10/1975 | Lecrone | 83/4 |
| 4,015,492 | 4/1977 | Terragnoli | 83/4 |

*Primary Examiner*—Joseph M. Golian
*Assistant Examiner*—Elizabeth A. Hatcher
*Attorney, Agent, or Firm*—George W. Price; Charles J. Worth

[57] ABSTRACT

An improved hamburger bun and the method of preparation by slicing the bun to leave a thin frangible web diametrically across the bun interconnecting the upper and lower bun portions for packaging.

2 Claims, 4 Drawing Figures

HAMBURGER BUNS AND METHOD OF PREPARING SAME

This invention relates generally to preparing hamburger buns for packaging and more particularly to prepackage slicing such buns.

It has been the common practice to slice hamburger and frankfurter buns or rolls leaving an uncut hinge portion at one side, thus keeping the cut halves together. As taught by U.S. Pat. No. 3,911,769 to Lecrone, the uncut hinge portion of a frankfurter roll is normally sufficiently large and strong to keep the two portions of the roll interconnected for use. However, unlike a frankfurter roll, the two parts of a sliced hamburger bun after unwrapping, are usually separated from each other for toasting or for insertion of a meat patty therebetween.

It has been found that when separating the two portions of a hamburger bun, the hinge portion normally does not tear along the cut line. The hinge portion normally remains with one part of the bun forming a protrusion extending outwardly from the cut surface which chars when the bun is toasted and is objectionable.

Other means have been proposed for prepackage semi-dividing of bakery goods. U.S. Pat. No. 2,738,817 to Wadoz teaches bun slicing around the bun periphery which when used, is torn apart. U.S. Pat. No. 3,192,976 to Clock teaches automatically preforking baked goods, such as english muffins, to facilitate their being torn apart for use.

An object of the present invention is to provide a method of cutting or slicing buns leaving an interconnection holding the cut bun portions together for packaging and which forms substantially smooth contiguous surfaces with the cut surfaces when the bun is torn apart or separated.

In essence, the present invention contemplates cutting or slicing a bun with a pair of spaced rotating blades which leaves a relatively thin, substantially diametrical web. It has been found that the crusty edges of the web are normally removed by the cutting blades leaving a thin shallow web of the soft insides of the bun which separates easily with surfaces comparatively smooth and substantially contiguous with the cut surface.

The foregoing and other objects and advantages will appear more fully hereinafter from a consideration of a detailed description wherein one embodiment of the invention is illustrated by way of example. It is to be expressly understood, however, that the drawing is for illustration purposes only and is not to be construed as defining the limits of the invention.

Figure 1:
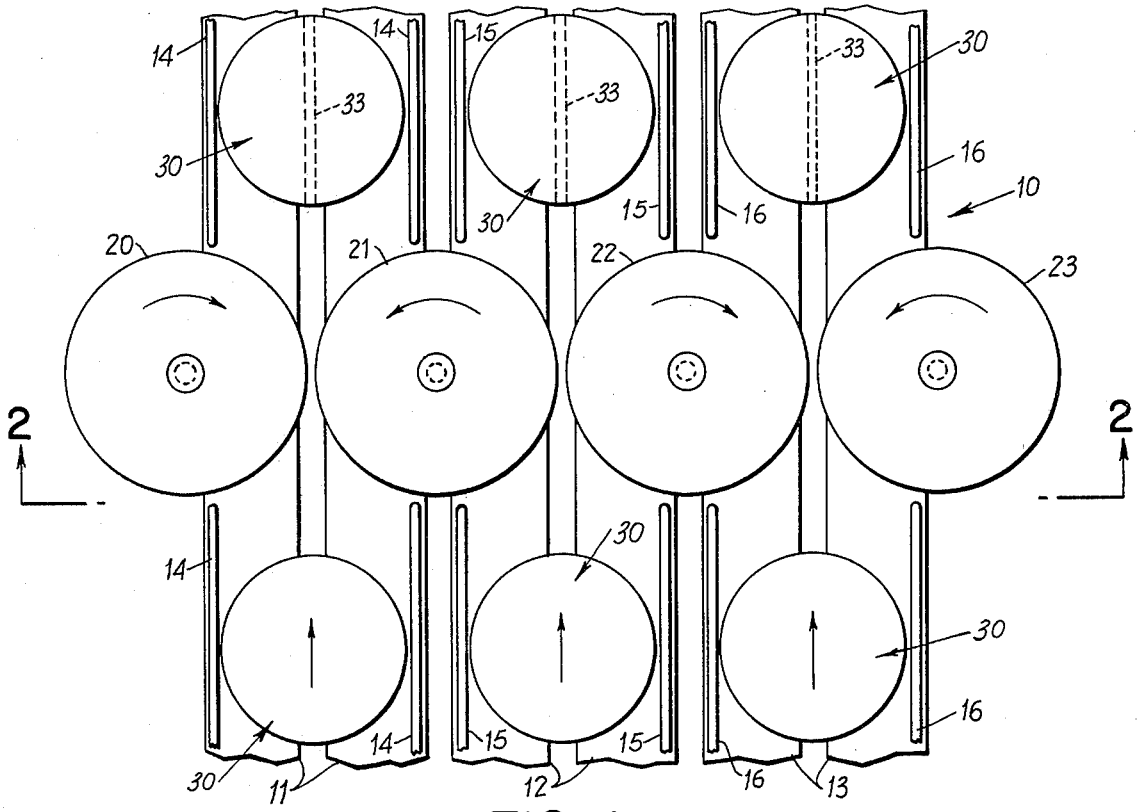
FIG. 1 is a fragmentary plan view of a portion of a machine or apparatus for slicing buns in accordance with the present invention.
Figure 2:
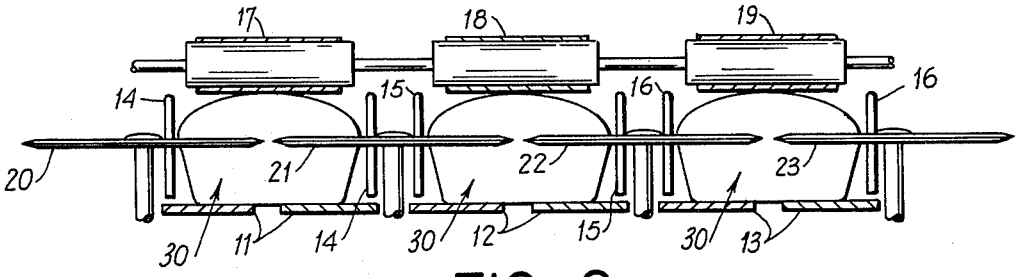
FIG. 2 is a sectional view taken on line 2—2 of FIG. 1.

Referring now to the drawings and particularly to FIGS. 1 and 2, a machine 10 (shown in part) is provided with three parallel endless belt type conveyors 11, 12 and 13 each provided with a pair of adjustable guide rails 14, 15 and 16, respectively. A set of four rotating blades 20 . . . 23 are disposed laterally across the conveyors in spaced pairs 20 and 21, 21 and 22, and 22 and 23, which cooperate to slice buns 30 delivered by the respective conveyors 11, 12 and 13.

Any suitable hold down means such as top rails or idler belts 17, 18 and 19 as shown in FIG. 2, are provided to operatively cooperate with the respective conveyors 11, 12 and 13 to feed single buns 30 past the rotating cutting blades 20 . . . 23 and to prevent the buns from turning while being cut. As shown by the arrows in FIG. 1, the blades of each of the spaced pairs of blades 20 and 21, 21 and 22, and 22 and 23, each rotate in a direction opposite to the direction of the other blade so as not to exert a force tending to urge a bun 30 being cut to rotate.

Although the machine or apparatus 10 is shown and described as having three bun feeding and cutting means, this number has been arbitrarily chosen for description purposes only an is not intended to define the limits of the present invention. Also, the machine or apparatus 10 is intended to be merely representative of any conventional bun slicing equipment which has been suitably modified to cut or slice buns in accordance with the present invention.

Figure 3:
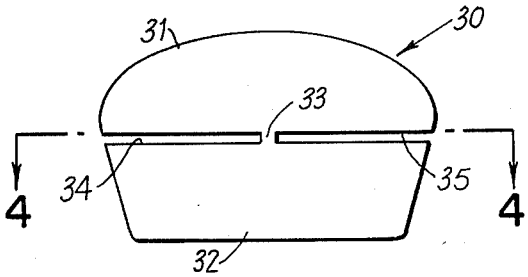
FIG. 3 is an elevational view of a bun cut in accordance with the present invention.
Figure 4:
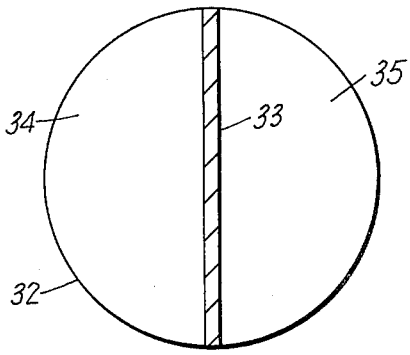
FIG. 4 is a sectional view taken on line 4—4 of FIG. 3.

Referring now to FIGS. 3 and 4, a bun 30 delivered by one of the conveyors 11, 12 or 13 is simultaneously cut in the same plane as shown in FIG. 2 by the associated pair of rotating blades 20 and 21, 21 and 22, or 22 and 23 which provide cuts 34 and 35 that extend inwardly toward each other from opposite sides of the bun and in part, separate the upper bun portion 31 and the lower bun portion 32. The space between the pair of rotating blades leaves a relatively thin diametrical shallow frangible web 33 which is defined by the depths of the cuts 34 and 35, and interconnects the upper bun portion 31 and the lower bun portion 32 to facilitate packaging.

As previously set forth, it has been found that when a bun 30 is cut or sliced in this manner the crust at the ends of the web 33 is normally torn away, or at least broken or fractured. Now when the sliced bun 30 is opened for use, separation occurs easily across the web 33 leaving a very slightly elevated surface between the surfaces of the cuts 34 and 35 on both bun portions 31 and 32 which are actually inperceivable to the eye and are substantially contiguous with the surfaces of the cuts.

Although but a single embodiment of the invention has been illustrated and described in detail, it is to be expressly understood that the invention is not limited thereto. Various changes may also be made in the design and arrangement of the parts without departing from the spirit and scope of the invention as the same will now be understood by those skilled in the art.

What is claimed is:

1. A method of preparing a hamburger bun for packaging, comprising the steps of conveying a single hamburger bun while preventing said bun from turning along a path between a pair of spaced rotating blades thereby providing cuts in the same plane on opposite sides of the bun by the blades for at least partially separating said bun into upper and lower bun portions while leaving a relatively thin shallow frangible web inside the bun extending substantially across the bun between the cuts thereby interconnecting the upper and lower bun portions for packaging and whereby said bun separates easily with the separated web being comparatively smooth and substantially contiguous with the surfaces of the cuts.

2. The method in accordance with claim 1, and contacting the top of the bun while being cut thereby preventing said bun from turning.

* * * * *